US008773485B2

(12) United States Patent
Giro Amigo

(10) Patent No.: US 8,773,485 B2
(45) Date of Patent: Jul. 8, 2014

(54) SYSTEM FOR QUICK COUPLING OF REELS TO A ROTATING SHAFT, AND DEVICE AND REEL IMPLEMENTING THE SYSTEM

(75) Inventor: Ezequiel Giro Amigo, Badalona (ES)

(73) Assignee: Girnet Internacional, S.L., Badalona (ES)

( * ) Notice: Subject to any disclaimer, the term of this patent is extended or adjusted under 35 U.S.C. 154(b) by 98 days.

(21) Appl. No.: 13/513,138

(22) PCT Filed: Oct. 29, 2010

(86) PCT No.: PCT/ES2010/070707
§ 371 (c)(1),
(2), (4) Date: Jul. 19, 2012

(87) PCT Pub. No.: WO2011/067445
PCT Pub. Date: Jun. 9, 2011

(65) Prior Publication Data

US 2012/0274721 A1 Nov. 1, 2012

(30) Foreign Application Priority Data

Dec. 1, 2009 (ES) ..... 200902261

(51) Int. Cl.
*B41J 2/325* (2006.01)

(52) U.S. Cl.
USPC ..... 347/222

(58) Field of Classification Search
USPC ..... 347/171, 215, 218, 221, 222
See application file for complete search history.

(56) References Cited

U.S. PATENT DOCUMENTS

| | | | |
|---|---|---|---|
| 2,705,112 | A | 3/1955 | Baumgartner |
| 5,991,963 | A | 11/1999 | Tourigny |
| 6,230,999 | B1 | 5/2001 | Tanaka |
| 2007/0059081 | A1 | 3/2007 | Silverbrook et al. |

FOREIGN PATENT DOCUMENTS

| | | | |
|---|---|---|---|
| DE | 26 22 539 | A1 | 12/1977 |
| DE | 44 37 623 | A1 | 4/1996 |
| DE | 199 27 264 | A1 | 12/1999 |
| EP | 0 857 678 | A1 | 8/1998 |
| EP | 2 036 845 | A2 | 3/2009 |
| GB | 196605 | A | 4/1924 |
| JP | 10-119376 | A | 5/1998 |

OTHER PUBLICATIONS

International Search Report for PCT/ES2010/070707, dated May 2, 2011.

*Primary Examiner* — Kristal Feggins
(74) *Attorney, Agent, or Firm* — Sughrue Mion, PLLC

(57) ABSTRACT

A system for the quick coupling of reels to a rotating shaft especially suitable for the unwinding or winding in reels of a consumable of thermal transfer printing or direct thermal printing machines, including a rotating shaft provided with a plurality of housings each of which is suitable for the firm but removable coupling of a rod, a single rod being able to be selectively coupled in any one of the mentioned housings; and a set of reels of a different width, provided with respective tubular bodies for the winding of the consumable provided with at least one respective slot suitable for the bayonet mount thereof with the shaft through the rod coupled in said shaft. The arrangement of the housings and of the slots are such that it is possible to couple any of the reels in such a way that said reels are centered with respect to a same plane transverse to the shaft.

14 Claims, 1 Drawing Sheet

SYSTEM FOR QUICK COUPLING OF REELS TO A ROTATING SHAFT, AND DEVICE AND REEL IMPLEMENTING THE SYSTEM

CROSS REFERENCE TO RELATED APPLICATION

This application is a National Stage of International Application No. PCT/ES2010/070707, filed on Oct. 29, 2010, which claims priority from Spanish Patent Application No. P 200902261, filed on Dec. 1, 2009, the contents of all of which are incorporated herein by reference in their entirety.

TECHNICAL FIELD OF THE INVENTION

The present invention relates to a system for the quick coupling of reels to a rotating shaft, especially suitable for the unwinding or winding in reels of a consumable of thermal transfer printing or direct thermal printing machines. The invention also relates to a device and to a reel especially suitable for the implementation of the system.

BACKGROUND OF THE INVENTION

Currently, there are different techniques for thermal printing, such as direct thermal printing or transfer printing, for example.

The common element for said thermal printing techniques is that they use a printing head, which, by means of heat, forms an image on a substrate, for example, a paper.

Direct printing is achieved by means of a chemical reaction of the components of the paper which is used, and which react with the heat of the printing head, the image on the paper thus being produced.

On the other hand, transfer printing is achieved by means of an ink which is in a polyester ribbon contacting the substrate, for example a paper or a plastic film. The ink used has a wax, resin or mixed base, according to the characteristics of the substrate and the durability desired for the printing. Thus, when the printing head is heated, the ink melts and when it contacts the cold substrate, the image is transferred to the mentioned substrate. The polyester ribbon having the ink is known as ribbon in the printing sector.

Reels suitable for the unwinding and winding of the ribbons which incorporate the ink for printing are used for both technologies, which reels are coupled in respective rotating shafts, which at least one of which is motorized or is driven.

The coupling of the reels in a corresponding rotating shaft becomes an object of interest in printing machines to facilitate the replacement and correct operation thereof, and different alternatives are known for the fixing of the reel in the rotating shaft.

As examples of such developments, a stop which must be placed at one end of the rotating shaft, more specifically at the base of the shaft, before placing the reel; and a tightening element, such as a nut, at the opposite end, which presses the reel against the stop, preventing its accidental removal, are currently used. A specific stop must be used for each reel width in order to ensure that the reel is kept coupled in a centred manner in the rotating shaft for a correct winding or unwinding, and to ensure a correct printing. This development necessarily involves the provision of several stops, in correspondence with the dimensions of the various reels, in addition to the use of a removable part, separable from the rotating shaft, formed by the tightening element or a similar element.

Rotating shafts are also known which incorporate complex expansible stop elements, and retaining means comprising sinkable tabs, which are not very satisfactory due to their high cost and complexity.

Therefore, a new simpler system and a device for the quick coupling of reels to a rotating shaft applicable to thermal transfer printing or direct thermal printing machines, which facilitates the replacement of the reels and which is more versatile, capable of adapting easily to different reel sizes without the need of having to replace the components thereof with others of different sizes, are necessary.

DISCLOSURE OF THE INVENTION

The system object of the present invention, which solves the aforementioned problems, consists of providing the rotating shaft with a plurality of housings, distributed along its length, each of which is suitable for the firm but removable coupling of a rod and such that one of the ends of said rod protrudes from the outer surface of the shaft, a single rod being able to be selectively coupled in any one of the mentioned housings; and of providing a set of reels comprising reels of a different width, provided with respective tubular support bodies for the winding of the consumable, provided with at least one respective slot suitable for the bayonet connection thereof with the shaft through the rod coupled in said shaft, and the arrangement of the housings in the shaft, as well as the length of the slots being such that it is always possible to couple any of the reels in such a way that said reels are centred with respect to a same plane (11) transverse to the shaft.

According to another feature of the invention, the rod is coupleable to the shaft by means of threading.

According to a preferred embodiment of the invention, the rod is finished with a flared head.

According to another aspect of the invention, a new device for unwinding or winding in reels a consumable in the form of a continuous strip or band, suitable for implementing said system, is disclosed,.

The device for the implementation of the system of the present invention is essentially characterized in that it comprises a motorized or driven rotating shaft intended to be inserted into the tubular body of a reel which serves as a support for the winding of the consumable.

The device is essentially characterized in that said shaft is provided with several housings, distributed along the shaft, suitable for receiving the firm but removable coupling of a rod and such that one of the ends of the rod protrudes from the outer surface of the shaft.

Furthermore, a new reel for the implementation of the system according to the invention is disclosed, characterized in that it is provided with a tubular support body for the winding of the consumable, provided with at least one slot extending from the edge of one of the ends of the tubular body, suitable for the bayonet connection thereof with the shaft through the rod coupled in said shaft.

According to another feature of the invention, the reel is provided with several slots equidistant from one another. According to a preferred embodiment of the invention, the slot is essentially T-shaped Furthermore, according to another feature of the invention, the slot is provided with a termination bent towards the edge of the tubular body.

Other aspects of the invention are a winding of a thermal transfer ribbon, supported in a reel according to any one of claims 6 to 9, and the use of a system according to the invention for the coupling of a reel of a thermal transfer ribbon to a printing machine.

BRIEF DESCRIPTION OF THE DRAWINGS

The attached drawings illustrate, by way of a non-limiting example, an embodiment of the system according to the invention and different variants of a reel for its implementation. In said drawings.

DETAILED DESCRIPTION OF THE DRAWINGS

Figure 1:
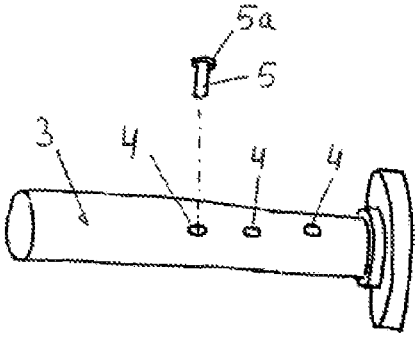
FIG. 1 is a schematic and perspective view of the rotating shaft of the system according to the invention.
Figure 2:
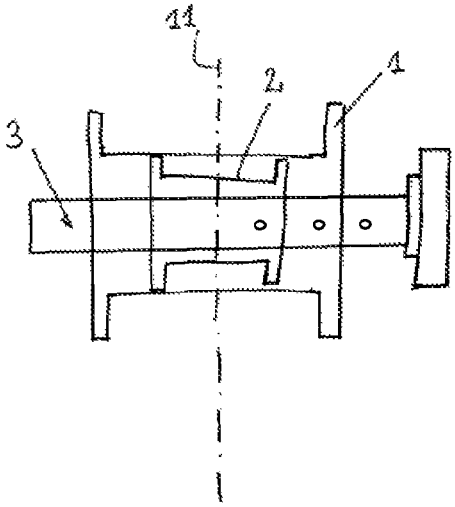
FIG. 2 is a schematic view, in which two reels of a different size, suitably coupled in the same shaft have been depicted in a superimposed manner.

FIG. 1 shows a rotating shaft 3 especially suitable for the implementation of the invention; and FIG. 2 shows two reels 1 and 2, of a different size, which are part of a set of multiple reels, all of them suitable, as is explained below, for being assembled on the shaft 3, and for rotating together with said shaft 3.

In the embodiment, the rotating shaft 3 is provided with three housings 4 which are distributed along its length. Each housing 4 is suitable for the firm but removable coupling of a rod 5, finished with a flared head 5*a*, which protrudes from the outer surface of the shaft 3 when the rod 5 is correctly coupled to the mentioned shaft 3, by means of threading ,for example.

Reels 1 and 2, of a different width, are provided with respective tubular support bodies 6 for the winding of the consumable, such as an ink-carrying ribbon or a continuous band on which self-adhesive labels are arranged.

The tubular body 6 of the reels 1 and 2 (see FIGS. 3*a*, 3*b* and 3*c*) are provided with a series of slots suitable for the bayonet connection of the reels to the shaft 3 through the rod 5 firmly coupled in one of the housings 4 of said rotating shaft 3.

According to a variant of the invention, the arrangement of the corresponding housings 4 in the rotating shaft has been deliberately selected according to the known dimensions of the reels, such that the coupling of any of the reels 1 or 2 in the shaft 3 such that the latter are centred with respect to one and the same plane 11 transverse to the shaft 3 is always possible. To that end, it is only necessary to select in which housing 4 the rod 5 is coupled before placing or assembling the reel in the shaft 3. For the purpose of representing this feature, FIG. 2 depicts the two reels 1 and 2 on the shaft 3 at the same time. For the assembly of the larger reel 1, the rod 5 must be coupled in the intermediate housing, whereas for the assembly of the smaller reel 2, the rod 5 must be coupled in the housing farthest from the base of the rotating shaft 3. In any case, by suitably selecting the location of the rod 5 it is possible to achieve that any of the reels 1 or 2 is centred with respect to the transverse plane 11.

Other variants of the invention contemplate that the length of the slots made in the different reels forming the set of reels may vary from one reel to another, the arrangement of the housings 4 in the shaft 3 and the length of the slots in each of the reels being such that the coupling of any of the reels such that it is centred with respect to the transverse plane 11 is always possible.

Figure 3A:
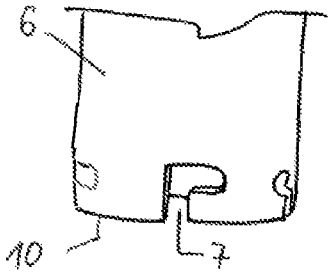
FIGS. 3*a* 3*b* and 3*c* are respective schematic and sectioned views of three types of reels which differ from one another in the shape of their slots.
Figure 3B:
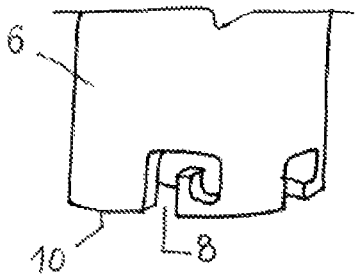
Figure 3C:
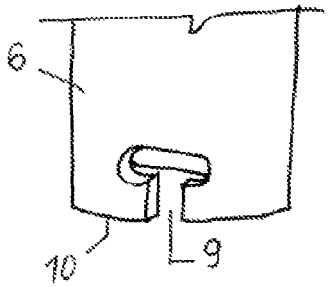

FIGS. 3*a*, 3*b* and 3*c* depict different variants for a tubular body 6 of a reel suitable for the implementation of the invention. It is observed in the variant of FIG. 3*a* that the slot 7 has an L shape typical for a simple bayonet connection. In FIG. 3*b*, the slot 8 has a termination bent towards the edge of the tubular body 6, which ensures the security of the connection between the reel and the shaft 3 in the event that the direction of rotation of the shaft 3 is reversed.

With respect to the variant of FIG. 3*c*, it is observed that the slot 9 is essentially T-shaped, a shape which is particularly advantageous for reels of ribbons in thermal transfer printing or thermal printing machines. For this particular use, the reel can be used indistinctly to collect or wind the ribbon in use or to provide the printing system with the ribbon, because whichever the direction of rotation of the shaft 3, the rod 5 will be held tightly housed in one branch of the T-shaped slot 9 or another, the accidental removal of the reel being prevented.

Naturally, providing the tubular body 6 of the reels with several slots, preferably distributed regularly along one of the end edges thereof, to facilitate its assembly on a shaft 3, is envisaged.

The invention claimed is:

1. A system for the quick coupling of reels to a rotating shaft for the unwinding or winding in reels of a consumable for thermal transfer printing or direct thermal printing machines, comprising:

a rotating shaft provided with a plurality of housings, distributed along a length of the shaft, each of the housings configured for the firm but removable coupling of a rod and such that one end of said rod protrudes from an outer surface of the shaft, the rod being able to be selectively coupled in any one of the housings; and a set of reels, each having a different width, each reel provided with a respective tubular support body for the winding of the consumable, each reel provided with at least one slot suitable for a bayonet connection with the shaft through the rod coupled in said shaft, and the arrangement of the housings in the shaft, as well as a length of each slot, being such that it is always possible to couple any of the reels in such a way that said reels are centred with respect to a same plane transverse to the shaft.

2. The system according to claim 1, characterized in that the rod is coupleable to the shaft by threading.

3. The system according to claim 1, characterized in that the rod is finished with a flared head.

4. The system according to claim 1, wherein the rotating shaft is a motorized or driven rotating shaft.

5. A thermal transfer printing machine incorporating the system according to claim 4.

6. The system according to claim 1, wherein the slot for at least one of the tubular support bodies for the winding of the consumable extends from an edge of an end of the tubular body and is configured for the bayonet connection with the shaft through the rod coupled in said shaft.

7. The system according to claim 6, characterized in that the slot is provided with a termination bent towards the edge of the tubular body.

8. The system according to claim 6, wherein each reel further includes several slots equidistant from one another.

9. The system according to claim 6, wherein the slot is essentially T-shaped.

10. The system according to claim 6, comprising a thermal transfer ribbon supported by the at least one of the reels.

11. The system according to claim 1, wherein the system is configured to couple a reel of a thermal transfer ribbon to a printing machine.

12. The system according to claim 1, wherein the rod has an elongated body portion and a head having a width larger than a width of the body and wherein the head is outside of the bayonet connection.

13. A system for coupling reels to a rotating shaft, the system comprising:

a shaft having a plurality of openings distributed along a length of the shaft;

an elongated member configured to be removably coupled to one of the plurality of openings so as to selectively position the elongated member along the shaft, wherein the elongated member protrudes from an outer surface of the shaft when coupled to one of the plurality of openings; and a set of reels, each having a different width as measured along a rotational axis of the respective reel, each reel provided with at least one slot, at least a portion of the slot being transverse to a rotational axis of the respective reel, the slot configured to releasably couple the reel to the shaft via the elongated member, wherein the slots and openings are arranged so that each reel is configured to be coupled to the shaft with a center of the reel relative to the width of the reel being positioned in a common plane extending through and transverse to the shaft.

14. The system according to claim 13, wherein the slot is configured to releasably couple the reel to the shaft with the elongated member in the form of a bayonet coupling.

* * * * *